US006729614B2

(12) United States Patent
Okazaki et al.

(10) Patent No.: US 6,729,614 B2
(45) Date of Patent: May 4, 2004

(54) SHEET FEEDING APPARATUS

(75) Inventors: Shigeru Okazaki, Hachioji (JP); Daisuke Ueda, Hachioji (JP); Kenji Kato, Hachioji (JP)

(73) Assignee: Konica Corporation (JP)

( * ) Notice: Subject to any disclaimer, the term of this patent is extended or adjusted under 35 U.S.C. 154(b) by 51 days.

(21) Appl. No.: 10/225,380

(22) Filed: Aug. 21, 2002

(65) Prior Publication Data

US 2003/0057633 A1 Mar. 27, 2003

(30) Foreign Application Priority Data

Aug. 29, 2001 (JP) ..... 2001-259081

(51) Int. Cl.[7] ..... B65H 3/14; B65H 3/52
(52) U.S. Cl. ..... 271/97; 271/121
(58) Field of Search ..... 271/97, 121

(56) References Cited

U.S. PATENT DOCUMENTS 4,690,395 A * 9/1987 Nowicki ..... 271/98
5,110,110 A * 5/1992 Wirz et al. ..... 271/98
6,264,188 B1 * 7/2001 Taylor et al. ..... 271/98

FOREIGN PATENT DOCUMENTS

JP 2003-206041 * 7/2003 ..... B65H/3/08

* cited by examiner

*Primary Examiner*—Donald P. Walsh
*Assistant Examiner*—Kenneth W Bower
(74) *Attorney, Agent, or Firm*—Muserlian, Lucas and Mercanti

(57) ABSTRACT

A sheet feeding apparatus includes a sheet feeding roller that comes in contact with stacked sheets and feeds sheets one by one from the top, wherein an air outlet is provided so that air can be blown onto the upper part of the stacked sheets from the lateral side in the sheet feeding direction, and a floatation suppression member for suppressing floatation of the sheets is provided between the air outlet and the sheet feeding roller and spaced apart from the uppermost surface of the stacked sheets.

6 Claims, 4 Drawing Sheets

FIG. 1 ( a )
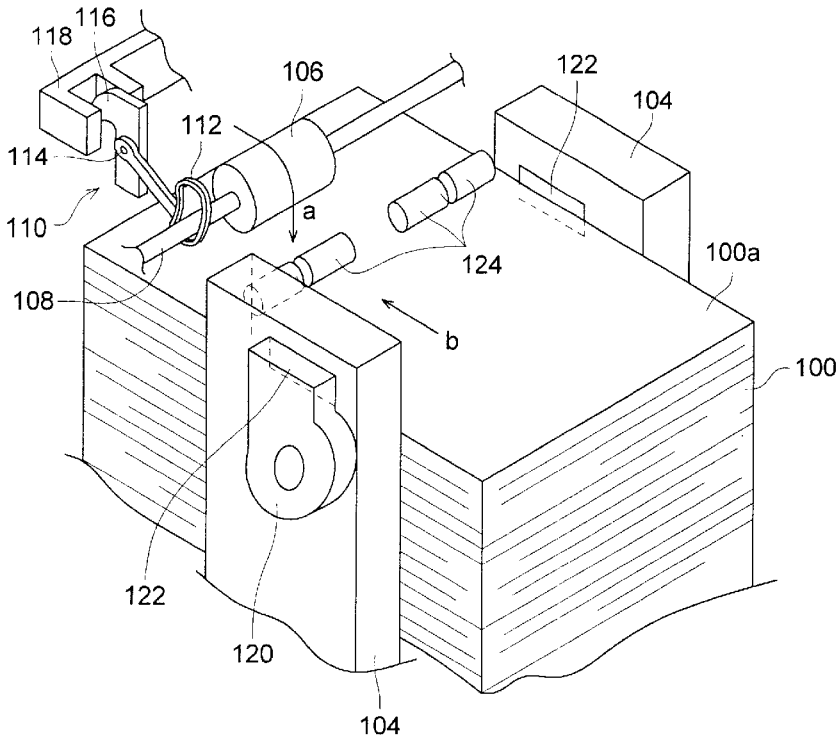
FIG. 1 ( b )
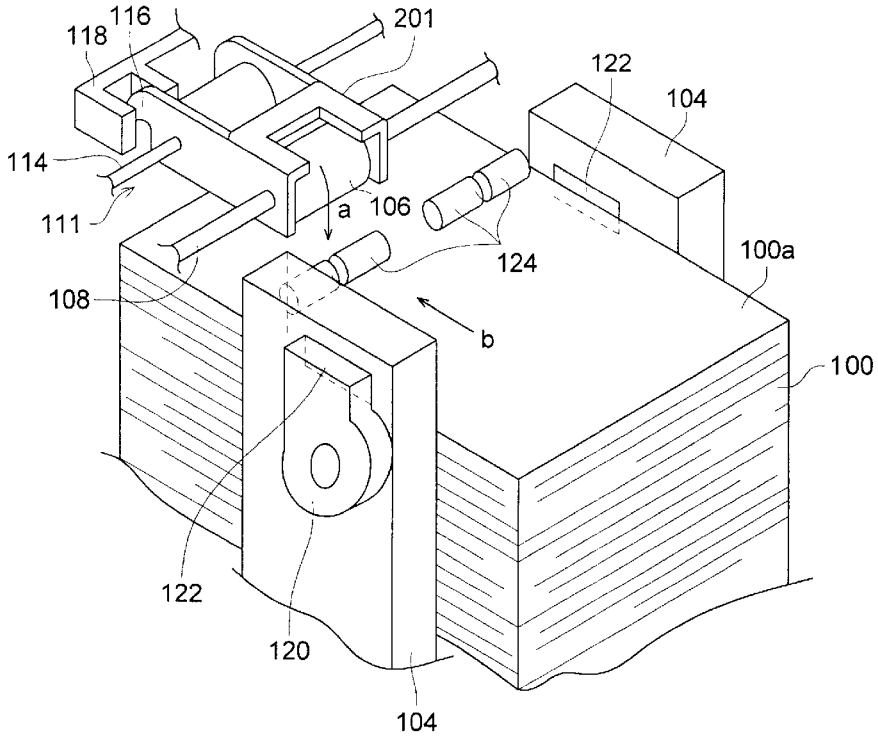

SHEET FEEDING APPARATUS

BACKGROUND OF THE INVENTION

The present invention relates to a sheet feeding apparatus used in copy machines, printers, printing machines, etc. and more specifically to a sheet feeding apparatus capable of separately feeding various types of sheets such as transparent sheets, scored papers, etc.

Copy machines, printers, and printing machines are equipped with a sheet feeding apparatus that feeds sheets one by one from a stack of copy paper by means of a sheet feeding roller. If this kind of sheet feeding apparatus feeds multiple sheets simultaneously, a paper jam may occur. If the feeding force is not strong enough, misfeeding may occur. To avoid these problems, there are methods to ensure that sheets are fed one by one. That is, increasing the friction coefficient between the sheet feeding roller and the sheet of paper so as to feed only the top sheet of the stack, thereby preventing misfeeding. An additional prevention against two or more sheets being fed simultaneously is a paper handling device, such as a paper handling roller, pat handler, or gripper, that does not allow sheets beneath the top sheet to advance so that only the sheet at the top of the paper stack is fed.

This method is effective only if ordinary copy paper is used. However, there has been an increased usage of copy machines and printers, which uses various different kinds of sheets such as transparent sheets, scored papers, and the like. Some types of paper adhere to one another when stacked that it is difficult for the above-mentioned sheet feeding apparatus to prevent two or more sheets from being fed simultaneously.

There is a proposed method that provides an air outlet on the lateral side to the sheet feeding direction of the paper stack, from which air is directed to several sheets at the top of the paper stack and flows through the sheets, thereby separating them. The sheets thus separated as mentioned above are fed one by one to the image forming section by means of a sheet feeding roller. Some printing machines employ a method of using suction to lift a sheet of paper located at the top of the stack and simultaneously transferring the sheet.

However, the suction method requires a compressor that can produce high suction, which results in large-scale equipment which increases power consumption and generates noise.

On the other hand, Japanese Publication Tokkaihei No. 04-23747 proposes, as shown in FIG. 5, a method in which air is blown from the lateral side to the feeding direction of the stacked sheets 100, and a lifted sheet is fed by means of a sheet feeding roller 2. This method also provides a hold-down member 3 at the rear end of the sheet 100 in the feeding direction so as to prevent sheets 100 from being lifted up excessively.

However, there is a problem with this method in that when the stacked sheets 100 are large, as shown in FIG. 5, several top sheets 100*b* of the stacked sheets 100 located in front of the air outlet 1 are lifted as a group. As a result, air does not flow through the sheets, thereby preventing individual sheets from being separated.

Furthermore, when a hold-down member 3 holds down the rear end of the stacked sheets 100, several top sheets 100*b* are inevitably lifted at the front end where a sheet feeding roller 2 is located. The sheet feeding roller 2 comes in contact with only a central part of the sheet; therefore, on both sides of the sheet feeding roller, several top sheets 100*b* of the stack are lifted, causing the following problems:

As stacked sheets are fed one by one from the top, the height of the uppermost surface of the paper stack is gradually lowered. This prevents the sheet feeding roller from coming in complete contact with the sheets, resulting in misfeeding. To prevent this, a sheet surface sensor is provided so that when the height of the uppermost surface of the paper stack is lowered, an elevating device lifts the stack of sheets 100 to maintain the stack at a certain height. This sheet surface sensor is generally located either on the left or right of the sheet feeding roller 2, that is the location where several top sheets 100*b* of the stacked sheets 100 are lifted. However, the position of the uppermost surface of the paper stack constantly changes in the vertical direction, consequently, it becomes impossible to reliably detect the position of the uppermost surface of the paper stack.

Moreover, when a hold-down member 3 is provided at the rear end of the stacked sheets 100, the location of the hold-down member 3 has to be changed according to different sizes of the sheets 100, thereby making the structure of the sheet feeding apparatus complicated.

SUMMARY OF THE INVENTION

To solve the above-mentioned problems, the primary object of the present invention is to provide a simply-structured sheet feeding apparatus that blows air on the stacked sheets from the lateral side to the sheet feeding direction, thereby individually separating the sheets regardless of the size of the sheets and reliably feeding the sheets one by one.

In addition to the above object, the secondary object is to provide a sheet feeding apparatus that can reliably measure the height of the uppermost surface of the stacked sheets without being influenced by the blown air.

To achieve the primary object, the present invention provides a sheet feeding apparatus comprising a sheet feeding roller that comes in contact with the stacked sheets and feeds sheets one by one from the top, wherein an air outlet is provided so that air can be blown from the lateral side onto the uppermost part of the stacked sheets in the sheet feeding direction, and also, a floatation suppression member for suppressing floatation of the sheets is provided between the air outlet and the sheet feeding roller, spaced from the uppermost surface of the stacked sheets.

To achieve the secondary object, in addition to the above structure, the sheet feeding apparatus according to the present invention comprises an elevating means for raising and lowering the stack of sheets as well as a sheet surface sensor for detecting the height of the uppermost surface of the stack, wherein the sheet surface sensor is disposed adjacent to the sheet feeding roller, and the floatation suppression member is located between the air outlet and the sheet surface sensor in the sheet feeding direction.

Furthermore, the sheet feeding apparatus according to the present invention can comprise a lateral adjusting member which moves freely in the direction that intersects with the sheet feeding direction so as to restrict the lateral positions of the stacked sheets and the lateral adjusting member has a fan that uses the air outlet for blowing out air; or the sheet feeding apparatus has a cover to which the floatation suppression member is mounted so that when the cover is opened and closed, the floatation suppression member is movable between its operating position and retracting position; or the floatation suppression member may be a rotatable roller.

BRIEF DESCRIPTION OF THE DRAWINGS

FIGS. 1(*a*) and 1(*b*) are perspective views of the main part of a sheet feeding apparatus according to the present invention with its cover removed;

DETAILED DESCRIPTION OF THE PREFERRED EMBODIMENT

Figure 2:
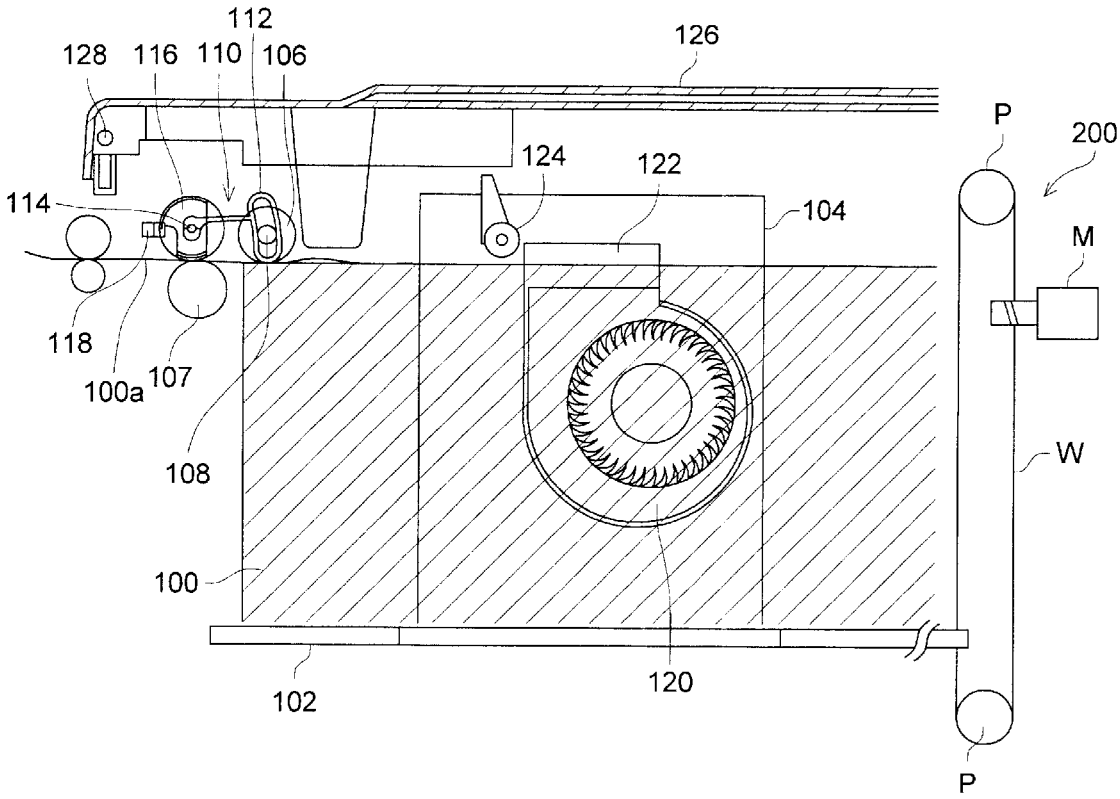
FIG. 2 is a longitudinal sectional view of the main part of the sheet feeding apparatus.
Figure 3:
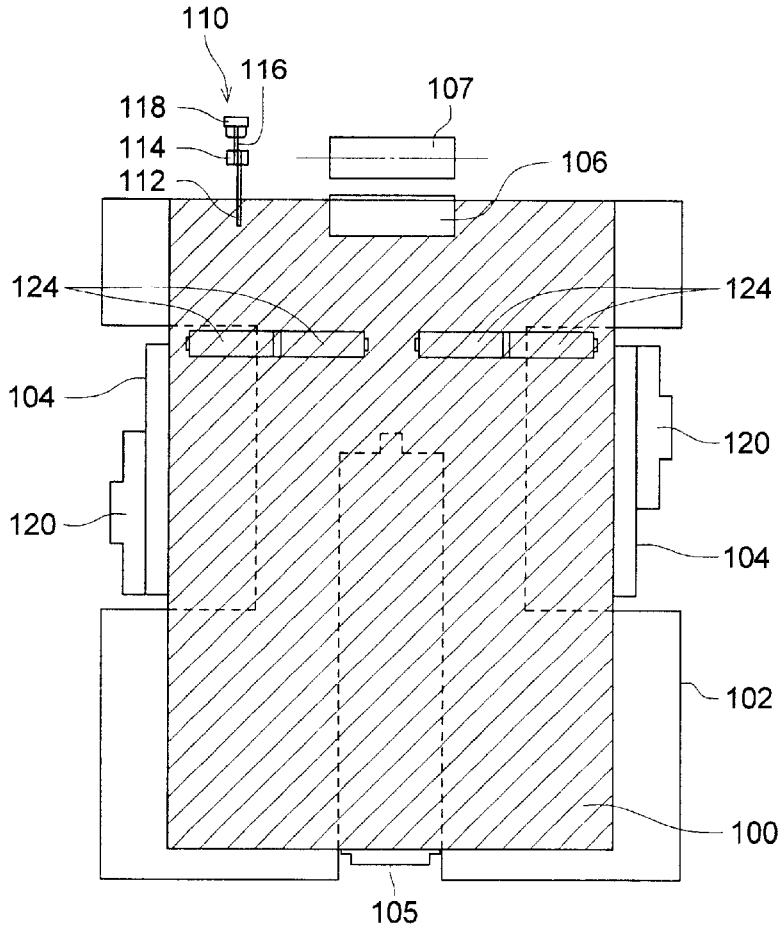
FIG. 3 is a top view of the main part shown in FIG. 1.

An embodiment of the present invention will be described hereinafter in reference to the drawings. FIGS. 1(*a*) and 1(*b*) are perspective views of the main part of a sheet feeding apparatus according to the present invention with its cover removed. FIG. 1(*a*) shows a view indicating a sheet surface sensor 110, while FIG. 1(*b*) shows a view indicating an another sheet surface sensor 111. FIG. 2 is a longitudinal sectional view of the main part of the sheet feeding apparatus. FIG. 3 is a top view of the main part shown in FIG. 1.

In these drawings, a stack of sheets 100 is placed on a tray 102 which has an elevation mechanism 200, as shown in FIG. 2, that raises and lowers the tray. Lateral adjusting members 104, such as side panels, etc., move freely in the direction that intersects with the feeding direction of the stacked sheets 100, that is, the width direction in this embodiment, and slightly come in contact with both lateral sides of the stacked sheets 100 to restrict the positions of the stacked sheets 100. A rear-end adjusting member 105 moves freely in the longitudinal direction of the stacked sheets 100 and adjusts the rear-end position in the sheet feeding direction. At the front end of the stacked sheets 100, a sheet feeding roller 106 is provided so that it is in press-contact with the top sheet 100*a* with proper force.

When the sheet feeding roller 106 rotates in the direction of arrow (a), the top sheet 100*a* moves in the direction of arrow (b), a paper handling roller 107 provided adjacent to the outlet side of the sheet feeding roller 106 pushes back the sheets in the stack located below the top sheet so that only the top sheet is fed to the image forming section.

To detect the height of the uppermost surface of the stacked sheets 100, a sheet surface sensor 110 is provided. The sheet surface sensor 110 has a detection section 112 which has an oblong and arcuate hole so that the shaft 108 of the sheet feeding roller 106 has a play, a rotating shaft 114 which rotatably supports the detection section 112, a shading plate 116 which is fixed to the detection section 112, and a photocoupler 118 which is provided so as to sandwich the front-end portion of the shading plate 116. The rotating shaft 114 is rotatably supported by a shaft of the paper handling roller 107. The detection section 112, which is heavier than the shading plate 116, maintains contact with the uppermost surface of the stacked sheets 100. When the position of the uppermost surface of the stacked sheets 100 is lowered, the detection section 112 is also lowered accordingly, and the tip of the shading plate 116 lifts, disengaging from the photocoupler 118. As a result, a light receiving section detects light, thereby detecting that the position of the top sheet 100*a* is lowered. Then, an elevating device 200 composed of, for example, an elevation motor M, pulleys P and a wire W, as shown in FIG. 2, operates to raise the stack of sheets 100 to a height at which the tip of the shading plate 116 blocks the light of the photocoupler 118. This mechanism makes it possible to maintain the position of the uppermost surface of the stacked sheets 100, that is, the position of the top sheet 100*a*, at a constant height. The sheet surface sensor 110 is not limited to the structure shown in drawings, but any structure is available if it can detect the position of the uppermost surface of the stacked sheets.

With reference to FIG. 1(*b*), a sheet surface sensor 111 having another components will be explained as follows.

The sheet surface sensor 111 is constituted by a holder member 201 rotatably supporting a shaft 108 of a sheet feeding roller 106, a rotating shaft 114 rotatably supporting the holder member 201, a shading plate 116 which is integrally formed on the holder member 201, and a photocoupler 118 provided so that the shading plate 116 is interposed between a light receiving section and a light emitting section constituting the photocoupler 118. Predetermined pressing force is applied onto the uppermost sheet 100*a* to feed the sheet 100.

When the position of the uppermost surface of the stacked sheet 100 as the feeding of the sheet 100 progresses, the sheet feeding roller 106 is lowered by rocking on the rotating shaft 114 as a fulcrum, thereby the tip end of the shading plate is raised, disengaging from the photocoupler. As a result the light receiving section detects light, thereby detecting that the position of the top sheet 100*a* is lowered. Then, the elevating device 200 operates to raise the stack of the sheet 100 to a height at which the tip of the shading plate 116 blocks the light of the photocoupler 118. This mechanism makes it possible to maintain the position of the uppermost sheet 100*a* of the stacked sheet 100, that is, the position of the top sheet 100*a*, at a constant height.

As explained above, since the sheet feeding roller 106 is constituted so that the predetermined pressure force is applied onto the uppermost sheet in order to feed surely the sheet, the sheet feeding roller has the advantage of suppressing the floating of the sheets awaiting to be fed, thereby the position of the top sheet can be stably maintained.

Small fans 120 are mounted upwardly to the lateral adjusting members 104. Air directed upward turns by 90 degrees by a fan mounting plate, not shown, and is blown out horizontally from air outlets 122. Air outlets 122 are located near the upper end of the lateral adjusting members 104. The width of the air outlet 122 is the same as that of the air port of the fan 120. It is desirable that the top sheet 100*a* be located at the center between both the upper and lower ends of the air outlet 122. Since each fan 120 is mounted to each lateral adjusting member 104, when the size of the stacked sheets 100 is changed, the fans 120 also move along by moving the lateral adjusting members 104. Furthermore, in this embodiment, fans 120 and air outlets 122 are provided at both lateral sides of the stacked sheets 100, however, it is also possible to provide a fan and an air outlet only at one side.

Rotating the fans 120 directs air from the air outlets 122 and the air blows on several top sheets of the stacked sheets 100. The air flows from one side through several top sheets 100*b* to the other side. Thus, several top sheets 100*b* of the stack are separated individually. The sheet feeding roller 106 picks up only the top sheet 100*a* from the separated sheets 100 and reliably feeds it.

Figure 5:
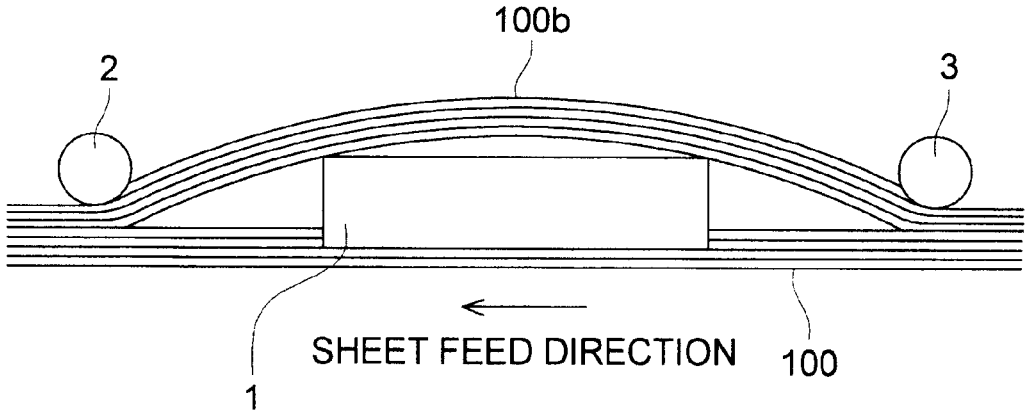
FIG. 5 PRIOR ART
FIG. 5 explains the operation of a conventional sheet feeding apparatus.

However, simply sending air from the lateral sides of the stacked sheets 100 may damage the sheets due to excessive floatation of the sheets as disclosed in Japanese Publication Tokkaihei No. 4-23747. It may also cause several sheets which adhere to one another to float without separation as shown in FIG. 5.

Figure 4:
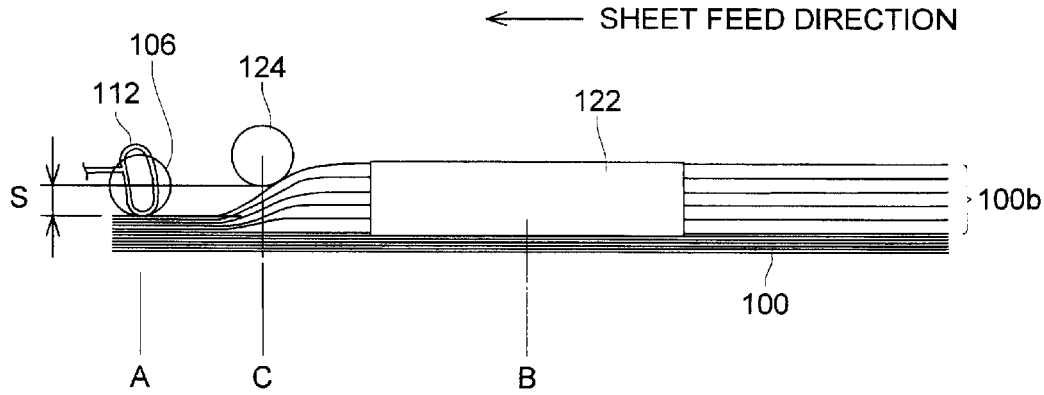
FIG. 4 explains the operation of the present invention.

Therefore, the present invention provides a floatation suppression member 124 between the air outlet 122 and the sheet feeding roller 106, as shown in FIGS. 1 and 4.

As shown in FIG. 4, in the sheet feeding direction, location C of the floatation suppression member 124 is positioned between position A where the detection section 112 comes in contact with the stacked sheets 100 and position B which is the central part of the air outlet 122.

By providing thus the floatation suppression member 124, the floatation of several top sheets 100*b* of the stacked sheets 100 expands toward almost entire front surface of the air outlet 122, as shown in FIG. 4, and clearances between each sheet becomes the same. Air flows through those clearances from one side to the other side. This mechanism successfully separates the sheets 100, thereby easily feeding the sheets one by one.

Furthermore, the floatation suppression member 124 does not come in contact with the uppermost surface of the stacked sheets 100, but is lifted by amount S from the lower end of the sheet feeding roller 106, that is, a floatation 0 (zero) position, as shown in FIG. 4. This reduces resistance generated when the floatation suppression member 124 feeds sheets.

The floatation suppression member 124 is mounted to the cover 126 of the sheet feeding apparatus, as shown in FIG. 2. The cover 126 can rotate around the front-end hinge 128. When the cover 126 is closed, the floatation suppression member 124 is located at a position to suppress the floatation of the sheets. When the cover 126 is opened, the floatation suppression member 124 retracts along with the cover 126 from the position where the member suppresses the floatation of the sheets 100. Due to this mechanism, when the cover 126 is opened to insert sheets 100, the floatation suppression member 124 is out of the way.

The floatation suppression member 124 can be of any shape if it can suppress the flotation of the sheets 100. However, providing a rotatable roller as shown in this embodiment reduces resistance generated when sheets are fed, thereby reducing loads applied on the sheet feeding roller 106.

Furthermore, it is preferable that the floatation suppression member 124 moves freely in the direction of the width of the sheets 100 according to the size of the sheets 100. By doing so, when the size of the sheets 100 is reduced, the floatation suppression member 124 can properly suppress the amount of floatation of the sheets 100. Also, providing clearance S between the floatation suppression member 124 and the uppermost surface of the stacked sheets 100 will make it possible to precisely control the floatation amount.

A fan driving method can be of various types. For example, the fan can be turned on when a printer or an image forming apparatus equipped with a sheet feeding apparatus is turned on; or the fan rotates or stops in synchronization with a motor that drives a sheet feeding roller 106 or a feed roller; or such operations can be controlled by an operating section. In any method, the fan must stop when the door is opened to remove a jammed sheet of paper.

As described above, a sheet feeding apparatus according to the present invention has air outlets on both lateral sides to the sheet feeding direction so as to direct air to the uppermost part of the stacked sheets, and also has a floatation suppression member for suppressing floatation of the sheets providing between the air outlets and the sheet feeding roller in the sheet feeding direction, spaced from the uppermost surface of the stacked sheets. This mechanism makes it possible to lift several top sheets of the stack providing clearances between each sheet, thereby separating individual sheets even though they are adhesive. This mechanism is effective regardless of the size of the sheets.

If an elevating means for raising and lowering a stack of sheets and a sheet surface sensor, disposed adjacent to the sheet feeding roller, for detecting the height of the uppermost surface of the stack are provided, it is possible to prevent the vicinity of the sheet surface sensor from being lifted, thereby maintaining the position of the surface of the top sheet at a constant height.

If lateral adjusting members for restricting the lateral positions of the stacked sheets are provided on both lateral sides to the sheet feeding direction and the lateral adjusting members have air outlets and fans that blow air from the air outlets, the air outlets automatically move when the lateral adjusting members move regardless of the size of the sheets. As a result, handling paper is facilitated.

If the sheet feeding apparatus has a cover with the floatation suppression member mounted to it and the floatation suppression member is made movable between its operating position and retracting position when the cover is opened and closed, the floatation suppression member is out of the way when the cover is opened to insert sheets.

What is claimed is:

1. A sheet feeding apparatus comprising:

(a) a sheet feeding roller for feeding an uppermost sheet of stacked sheets one by one by coming into contact with the stacked sheets;

(b) two air outlets through which air is blown toward both sides of an upper part of the stacked sheets in a horizontal direction perpendicular to a sheet feeding direction; and (c) a floatation suppression member provided between the two air outlets and the sheet feeding roller with respect to the sheet feeding direction and spaced apart from an upper surface of the stacked sheets for suppressing floatation of the sheets.

2. The sheet feeding apparatus of claim 1, further comprising an elevating means for raising and lowering the stack of sheets and a sheet surface sensor for detecting a height of the uppermost surface of the stack, wherein the sheet surface sensor is disposed adjacent to the sheet feeding roller, and the floatation suppression member is located between the two air outlets and the sheet surface sensor in the sheet feeding direction.

3. The sheet feeding apparatus of claim 2, further comprising lateral adjusting members movable in a direction intersecting with the sheet feeding direction for adjusting both lateral positions of the stacked sheets, wherein the lateral adjusting members each comprises the air outlet and a fan for blowing air through the air outlet used as a blowing nozzle.

4. The sheet feeding apparatus of claim 1, wherein the sheet feeding apparatus comprises a cover to which the floatation suppression member is mounted so that when the cover is closed and opened, the floatation suppression member is movable between an operating position and a retracting position, respectively.

5. The sheet feeding apparatus of claim 1, wherein the floatation suppression member is a rotatable roller.

6. The sheet feeding apparatus of claim 1, further comprising a sheet surface sensor for detecting a height of the uppermost surface of the stack, wherein the sheet surface sensor comprises a holding member for rotatably holding the sheet feeding roller, a shading member integrally formed on the holding member and a photocoupler between which a leading end of the shading member is interposed, and wherein the floatation suppression member is located between the air outlets and the sheet surface sensor in the sheet feeding direction.

* * * * *